US007293679B2

(12) United States Patent
Lo

(10) Patent No.: US 7,293,679 B2
(45) Date of Patent: Nov. 13, 2007

(54) CONTAINER FOR STORING AND POURING LIQUIDS

(75) Inventor: Kai Yip Lo, Flat 2, 145 Silverdale, SE26 4SQ Sydenham, London (GB)

(73) Assignees: Axel Mewes, Dusseldorf (DE); Kai Yip Lo, London (GB)

( * ) Notice: Subject to any disclaimer, the term of this patent is extended or adjusted under 35 U.S.C. 154(b) by 420 days.

(21) Appl. No.: 10/497,425

(22) PCT Filed: Oct. 25, 2002

(86) PCT No.: PCT/EP02/11935

§ 371 (c)(1),
(2), (4) Date: May 28, 2004

(87) PCT Pub. No.: WO03/047983

PCT Pub. Date: Jun. 12, 2003

(65) Prior Publication Data

US 2005/0006420 A1 Jan. 13, 2005

(30) Foreign Application Priority Data

Dec. 6, 2001 (DE) ..... 101 59 988

(51) Int. Cl.
*B65D 1/20* (2006.01)

(52) U.S. Cl. ..... 222/564; 222/454; 222/456; 222/479; 141/309; 141/364

(58) Field of Classification Search ..... 222/454–457, 222/479, 564; 141/309, 364
See application file for complete search history.

(56) References Cited

U.S. PATENT DOCUMENTS

| | | | | |
|---|---|---|---|---|
| 33,471 | A * | 10/1861 | Anderson | 141/309 |
| 236,997 | A | 1/1881 | Dodge | |
| 1,849,950 | A * | 3/1932 | Murdock | 141/309 |
| 2,370,820 | A | 3/1945 | Stott | |
| 4,236,655 | A | 12/1980 | Humphries | |
| 4,666,065 | A * | 5/1987 | Ohren | 222/109 |

(Continued)

FOREIGN PATENT DOCUMENTS

| | | |
|---|---|---|
| CH | 439 083 | 6/1967 |

(Continued)

*Primary Examiner*—J. Casimer Jacyna
(74) *Attorney, Agent, or Firm*—Andrew Wilford

(57) ABSTRACT

The invention relates to a container for storing and pouring liquids, which comprises an internal volume and a pouring opening (8). The interior volume is subdivided into a storage volume (3) and a withdrawal volume (4) which communicate with each other (10), said withdrawal volume (4) leading to the pouring opening (8) in such a manner that the pouring opening (8), when the container (1) is tilted between the critical angle and the overend position of the container (1), invariably is the bottom-most point of the withdrawal volume (4). The container has a ventilation pipe (17) that extends from the pouring opening (8) and leads to the storage volume (3). In the overend position, the housing areas (13) of the container (1) delimiting the storage volume (3) downward have a descending gradient towards the linking opening (10) or the linking channel between the storage volume (3) and the withdrawal volume (4) and/or the housing areas (25) of the container (1) delimiting the withdrawal volume (4) downward have a descending gradient towards the pouring opening (8).

14 Claims, 9 Drawing Sheets

U.S. PATENT DOCUMENTS

| | | | |
|---|---|---|---|
| 4,856,664 | A | 8/1989 | Gillispie et al. |
| 4,856,685 | A | 8/1989 | Gaffney |
| 5,356,053 | A | 10/1994 | Di Fatta |
| 5,503,284 | A | 4/1996 | Li |
| 2001/0054628 | A1 | 12/2001 | Harbaugh et al. |

FOREIGN PATENT DOCUMENTS

| | | |
|---|---|---|
| CH | 638 114 | 9/1983 |
| DE | 573385 | 3/1933 |
| DE | 30 17 457 | 11/1980 |
| DE | 34 41 172 | 5/1986 |
| DE | 41 00 742 | 7/1992 |
| EP | 0 144 104 | 6/1985 |
| EP | 0 157 673 | 10/1985 |
| EP | 0 402 574 | 12/1990 |
| EP | 0 657 358 | 6/1995 |
| GB | 506706 | 5/2005 |
| WO | 94/24011 | 10/1994 |
| WO | 99/33707 | 7/1999 |

* cited by examiner

CONTAINER FOR STORING AND POURING LIQUIDS

CROSS REFERENCE TO RELATED APPLICATIONS

This application is the US national phase of PCT application PCT/EP02/11935, filed 25 Oct. 2002, published 12 Jun. 2003 as WO/2003/047983 and claiming the priority of German patent application 10159988.9 itself filed 6 Dec. 2001.

FIELD OF THE INVENTION

The invention relates to a container, especially a bottle, for the storage and pouring of liquids with an interior and a pouring opening, whereby the interior is subdivided into a storage volume and a withdrawal volume which are interconnected so that in a normal vertical position of the container, the withdrawal volume is above the storage volume and an overflow of liquid from the storage volume into the withdrawal volume is prevented until the container is tilted beyond the predetermined limiting angle from the vertical position.

BACKGROUND OF THE INVENTION

The subdivision of the container volume into a storage volume and a withdrawal volume can be effected for example by a partition which is provided within the container volume. Such a partition can, for example, in an upright bottle-shaped container extend horizontally in the interior of the container above the liquid level and thereby separate the two volumes from one another. A connection of the volumes is effected through an opening or a passage in the partition or, for example, by having the partition extend from one side wall of the container only into a region proximal to the opposite side wall so that between the end of the partition and that side wall, a gap remains for passing the liquid.

Such a container which is of expensive construction and has the shape of a bottle is known from U.S. Pat. No. 4,856,685. With the construction disclosed in U.S. Pat. No. 4,856,685, it can be achieved, for example, with oil bottles for motor vehicle oil that the bottle can be rotated from its normal vertical standing position through an angle-up to 90° and thus into the horizontal recumbent position without oil flowing from the supply volume into the discharge volume and from there to the pouring opening.

Should one wish to fill a motor vehicle with oil in a tight engine compartment, there is always the problem of conventional oil bottles or containers, that when the bottle is very full, even a slight tilting of the bottle will result in oil spilling from the pouring opening, especially when the pouring opening of the oil bottle has not been positioned with sufficient precision over the oil filling fitting of the engine. In this case the oil can flow alongside the oil filling opening which is detrimental from an economical and ecological point of view.

With the container under discussion, for example, the oil bottle described in U.S. Pat. No. 4,856,685, it is possible to rotate or tilt the container initially from its normal angle standing position through a limiting angle, for example to a horizontal position (limiting angle of 90°) so that the pouring opening of the oil bottle can lie precisely above the filling fitting of the engine before oil emerges from the pouring opening of the oil bottle.

Only upon a further tilting beyond the limiting angle, for example the horizontal, that is through more than 90°, will oil flow from the supply volume, especially through a connecting opening or a connecting passage, into the withdrawal volume and can then flow from there to the pouring opening.

The construction of the conventional oil bottle has however the drawback that the oil flows initially into a region of the withdrawal volume which lies beneath the pouring opening and only upon complete filling of this region up to the lower edge of the pouring opening can the oil emerge therefrom.

A person who intends to discharge the liquid from such a container can do so only with difficulty if sensitivity is required since that individual cannot be certain when the liquid will emerge from the outlet opening because initially the liquid must pass from the supply volume into the withdrawal volume and then, when this is filled to a certain level, it can emerge from the outlet opening. A fine feel with respect to pouring is however of special importance, especially when liquids of potential danger are discharged from a vessel. A container of the described construction is therefore not suitable for a fine feel delivery and reliable discharge of such substances.

The vessels which are known and are used as oil containers have in addition the drawback that an equalization of the reduced pressure in the supply volume of the container which is produced as oil is discharged from the outlet opening and the connecting opening between the volumes, that is with the outflowing oil, cannot be readily achieved. Since such a pressure equalization does not occur continuously but rather in an impulsive and sudden manner when the reduced pressure in the supply volume drops below a certain reduced pressure, a uniform pouring of the oil from such known oil vessel is not possible. Because of the pulse-like pressure equalizing shocks, the oil is discharged likewise in pulses from the outlet opening of the bottle and that can give rise to the flow of oil even in the case of a previously precisely positioned outlet opening above the filling fitting, alongside a fitting which again from an economical and ecological point of view is a significant drawback. Especially with liquids which are hazardous, this drawback can pose a danger to the person holding the vessel as well as to the environment.

Furthermore, with the simple construction of the partition in an oil bottle according to U.S. Pat. No. 4,856,685, the storage volume of the oil bottle cannot be completely emptied since oil residue can accumulate on the surfaces of the partition which cannot be reliably delivered to the pouring opening or cannot be completely shaken from the withdrawal volume.

To the extent that an oil residue will remain in the bottle, namely, the known oil bottle according to U.S. Pat. No. 4,856,685, there can be an environmental impact in the disposal of the bottle, for example when the latter is used for oil or another liquid hazardous substance, and in addition, there is a loss in terms of the useful substance itself.

OBJECT OF THE INVENTION

The object of the invention is to provide a container, especially a bottle, for the storage and pouring of liquids of the type described at the outset, which enables a reliable, uniform pouring of the liquid and a complete emptying of residues from the container.

SUMMARY OF THE INVENTION

According to the invention, these objects are achieved in that the withdrawal volume opens into the pouring opening, and in that the pouring opening upon a tilting of the container between the limiting angle and the fully inverted position of the container is respectively at the lowest location of the withdrawal volume or the container housing region which is bounded by the withdrawal volume.

The objects are alternatively also achieved in that the container has a vent passage which extends from the pouring opening and opens into the supply or storage volume].

According to a further aspect of the invention, the objects are also achieved in that in a fully inverted position of the container, the housing region of the container bounding the supply or storage volume has a gradient in the direction of the connecting opening or the connecting passage between the storage volume and the withdrawal volume and/or that the withdrawal volume delimiting the housing regions of the container or the housing areas delimiting the withdrawal volume have a descending gradient in the direction of the pouring opening.

In the sense of the invention, by the "normal vertical position" of the container, a position will be understood in which the container or the bottle is usually upright and positioned for sale. In this position, the container housing extends customarily above a container base surface which in the normal vertical position of the container is oriented horizontally.

A further external configuration of the container in this vertical position is irrelevant with respect to the features which are important to the invention and, for example, the bottle can have a rectangular, round or other cross section and in addition, the cross section can vary toward the pouring opening located thereabove.

In the normal vertical position of the container, preferably the pouring opening is disposed at the upper end and as an example and preferably so that the mouth of the pouring opening is oriented parallel to the base surface of the container. In this orientation, the axis of a screw-type closure, which is preferably provided, is located perpendicular to the base surface of the container. Even this arrangement is, however, not required since the orientation of the pouring opening can have other angles.

In the normal vertical position, moreover, the interior of the container is subdivided into a storage or supply volume and a withdrawal or discharge volume, whereby the withdrawal volume is disposed above the storage volume. Both volumes are connected together, for example, through an opening or a passage.

By the "fully inverted" position of the container, a position is to be understood in which the pouring opening of the container is oriented downwardly and simultaneously the base surface of the container again is oriented horizontally. The fully inverted position thus corresponds to a rotation of the container through 180° from the normal vertical position.

The limiting angular position is the position which the container assumes upon being rotated from the normal vertical position until the liquid overflows with a further tilting from the storage volume into the withdrawal or discharge volume. With a rotation from the normal vertical position to this limiting angle, there is no liquid overflow or transfer between the volumes.

Depending upon the construction, the limiting angles can have different values. Basically any desired angle between 0° and 180° is possible whereby an angle in the range of 90°+30°, preferably a tilting of 90°, is selected as the limiting angular position, thus the position in which the container is horizontally oriented.

Height or altitude indications are, within the scope of this description, basically to be understood as relating to the gravitational effect.

In the limiting angular position beyond which an overflow from the supply volume to the withdrawal volume occurs can preferably and by way of example, correspond to a tilting through 90° from the normal vertical standing position and thus into a substantially horizontal arrangement of the container in which its base surface is oriented vertically and in which the liquid passes into the withdrawal volume and because of the gravitational effect, flows to its deepest position at which the pouring opening is located so that the liquid will immediately flow out of the pouring opening without accumulating initially in another region of the withdrawal volume.

Thus with the construction according to the invention, there is only one barrier which the liquid must overcome, namely, that between the storage volume and the withdrawal volume. Such a construction enables a highly sensitive metering discharge of liquid from the container which also enables such a container to be used for hazardous substances.

As has been previously described, according to an alternative of the invention, the separation into two volumes can be effected by means of a partition which then can have, for example, a throughgoing opening or a throughgoing passage. Also the connection of the two volumes can be effective in that the partition does not extend completely to one of the inner walls of the housing of the container so that an opening remains between the two volumes. The throughgoing opening or the throughgoing passage is located, in the case of a partition, close to a side wall of the container housing so that this opening, upon a tilting up to the limiting angle always remains above the liquid level and only upon a tilting beyond the limiting angle can it be traversed by the liquid.

The withdrawal volume can, according to another alternative and preferred manner of operation, be so configured that it forms a passage whose one end opens in the pouring opening and whose other end opens in the storage volume. Preferably in this case upon a tilting of the container up to the limiting angle, the withdrawal volume or the withdrawal passage opens in an upper region, especially in the highest area of the storage volume.

With a tilting of the container beyond the limiting value, this region is lowered until it passes below the liquid level so that liquid flows over from the storage volume into the withdrawal volume over the region forming the opening.

With respect to the normal vertical position of the container, this construction can also be so described that a container according to the invention has a withdrawal passage which rises in height and whose upper end opens in a pouring opening and whose lower end lies close to or bounds a lateral container wall to open through the upper housing wall of the container in the storage volume, whereby the withdrawal passage starting from one side wall of the container extends in the direction of the opposite side wall.

With this construction it can be ensured that with a tipping of the container between the limiting angle and the fully inverted position, the withdrawal passage will extend from the supply volume to the pouring opening in the direction in which gravity acts, and so that the pouring opening always forms the deepest location of the withdrawal passage or the withdrawal volume.

In this construction, the withdrawal passage can be formed in one piece on the container housing forming the storage volume or can be connected with the latter over suitable connecting means, for example, by a screw connection. Such a withdrawal passage which has an S-shaped configuration between its outer mouth openings, can be retrofitted onto an existing container.

It is advantageous when the mouth opening, through which the discharge passage is connected with the storage volume formed by the housing, is the highest point in the upper housing wall of the storage volume with reference to the vertical position of the container.

To stabilize the withdrawal passage above the supply volume, the passage beneath the pouring opening can be connected by means of a rib with the housing of the supply volume lying thereunder. This rib is preferably part of the container housing which forms the opening region between the two volumes so that between these regions of the container, a grip is formed and so that the discharge passage is also configured as a grip for the container.

If the container according to the invention is tilted from a normal vertical standing position beyond the limiting angle, for example in excess of 90°, the liquid disposed in the storage volume in construction with a partition, passes over its overflow edge or through an opening or, in the case of an inserted discharge volume or discharge passage, through the overflow opening or the overflow passage into the discharge volume and from there passes to the pouring opening.

In the case of only a slight tilting of the container beyond the above-mentioned limiting angle, the liquid merely wets the lower regions of the discharge volume or discharge passage and cannot completely fill the volume of the withdrawal passage lying thereabove. With this orientation of pressure, equalization can occur without problems between the storage volume and the external atmosphere.

If, however, the container or the bottle is tilted to a greater extent, the outflowing liquid will completely fill the connecting opening and/or the withdrawal volume. In that case a pressure equalization through the withdrawal volume or the withdrawal passage is no longer possible.

The construction of the container according to the invention which can be used also independently from the above-described construction provides that the container have a vent passage which extends from the pouring opening and opens into the storage volume.

Through implementing a vent passage which extends from the mouth of the pouring opening to the storage volume, the invention can achieve a continuous pressure equalization toward the pouring of the liquid. In this manner the development of an underpressure in the supply volume to a certain limiting value is precluded and also the induction of a large air volume through the container or pouring opening of the container is precluded which can give rise to an uneven discharge of the liquid. Through the vent passage, it is thus ensured that the liquid from the container will be uniformly discharged without an undesirable spurting and spraying of the liquid.

So that the vent passage which begins in the pouring opening will not draw liquid into it, the mouth of this vent passage with reference to the direction in which gravity acts is located at an upper region of the pouring opening which is not wetted by the outflowing liquid upon a tilting of the container.

Advantageously the vent passage is so arranged that this passage extends from the pouring opening to an opening mouth in the storage volume of the container which lies diametrically opposite the pouring opening.

Upon a tilting of the container beyond the limiting angle, the mouth opening of the vent passage is located at a position of the supply volume which forms the highest point of the container and at which the inflowing air can collect. Because of this construction, the mouth opening lies above the liquid level in the storage volume upon a tilting of the container beyond the limiting angle.

In this manner it can be ensured that the air entering through the vent passage does not have to pass at any point through the liquid which is to be poured out but rather is always delivered to an air space which increases continuously during liquid emitting at the upper end of the container so that the calm of the liquid within the container is in no way disturbed by the inflow of the air. Furthermore, this solution according to the invention with respect to the container construction renders the container suitable for liquid hazardous substances for which a reliable, uniform and controlled-quantity pouring must be ensured.

An especially simple configuration of the vent passage can be achieved when the vent passage is located in or on a wall of the container housing. Thus the vent passage can, for example, be considered directly with respect to fabrication of the container and can be made, for example, by the blow molding or even welding together of two container halves.

By means of these fabrication processes, a partition can be also made in the container. For example, the partition can be so formed in the housing wall that gripping troughs can be provided therein.

Preferably the vent passage in or on the region of the wall of the container housing is so configured that upon the described tilting of the container out of the vertical position, it extends upwardly with reference to the direction in which gravity acts. This can ensure that with a short vent passage, the liquid-emptied upper region of the storage volume can be connected with the ambient external air through the vent passage.

The function of the container according to the invention has already been described and from that it can be seen that the liquid first flows from the supply volume into the withdrawal volume when the container is tilted beyond a predetermined limiting angle and thus, for example, beyond the horizontal. Basically, any possible angle can here be established at which the transfer of liquid from the supply volume into the withdrawal volume can occur, for example, by displacing the opening or transition region connecting the volumes.

With a normal upright vertical stance of the container and a configuration of the vent passage within or on the container wall, whereby this vent passage has a mouth opening in the storage volume, which in the upright position of the container lies below the liquid level, based upon the number of communicating pipes, where in the vent passage the liquid level is exactly as high as it is in the storage volume.

Upon a tilting of the container out of this upright vertical stance into the horizontal position, the concern with the construction according to the invention is that no liquid pass from the supply volume into the withdrawal volume or to the pouring opening although it is possible that liquid which may be found in the vent passage will flow through the latter as a result of the tilting and because of the gravitational action to the pouring opening, especially because the vent passage in the horizontal position of the container at least in the end position allows the effect of gravity in its path to the edge of the pouring opening.

As a consequence, with a tilting of the container up to the horizontal position or up to the limiting angle, there will be indeed no liquid passing from the storage volume through the withdrawal volume up to the pouring opening, although the liquid from the vent passage can flow to the pouring opening and can drip from the end of the vent passage.

To prevent this, according to a preferred further feature of the invention, it is provided that in the limiting angular position of the container, the vent passage at least in a partial segment in the pouring direction will have an increasing height so that the liquid level within the vent passage in all positions of the container from the vertical standing position up to the limiting angle will have partial segments of the vent passage which have the aforementioned increasing height counter to the direction in which gravity acts. In this manner it can be ensured that with a tilting of the container from the vertical normal position until it is in the position of the limiting angle and thus, for example, practically in the horizontal orientation of the container, the liquid will flow in the vent passage through the rising segment of the vent passage because of the effective forces thereon, backwards into the storage volume along the inclined plane of the vent passage. Even upon a tilting of the container to the limiting angular position, there therefore cannot be any discharge of liquid from the vent passage in the direction of the pouring opening.

In order to realize this rising configuration of the vent passage, the construction preferably is such that the vent passage in its configuration has at least one passage segment which is disposed above the mouth opening upon the tilting of the bottle up to the limiting angle and through which the vent passage opens into the supply volume.

In order to provide an especially steep configuration of the vent passage in at least partial region thereof at the limiting angular position, it can be provided that the vent passage between the passage segment lying above the mouth opening and the mouth opening itself has at least a further passage segment which is located beneath the mouth opening. In this manner the vent passage has between these two points a sharply bent pattern which serves to provide a steep inclined plane in the passage segment of the vent passage which is disposed above the mouth opening so that the liquid is prevented from reliably passing out of the vent passage to the pouring opening.

To prevent an outflow of liquid reliably from the vent passage, it is according to the invention further provided that the described passage segment lying above the mouth opening to be arranged in every tilting position above the liquid level in the storage volume of the container.

This can be ensured when, in a horizontal orientation of the container or at the limiting angle and even with a vertical orientation of the container and thus the normal standing position, the passage segment which lies above the mouth opening is at least in part above the liquid level, especially above the transition opening between the volumes. The liquid level in the vent passage can then correspondingly not pass above the passage segment lying above the mouth opening in any tilting position.

Upon a tilting of the container, beyond the limiting angle or preferably beyond the horizontal position, the liquid passes from the storage volume into the withdrawal volume and thus fills the connecting opening between the two volumes completely with liquid so that a pressure equalization within the supply volume from this position is only possible through the vent passage. Upon a discharge of liquid from the pouring opening, a corresponding reduced pressure develops in the supply volume which draws in residual fluid remaining in the vent passage back and enables the residual liquid to drip from the end of the vent passage into the supply volume.

Thus the residual fluid in the vent passage remains until there is a tilting into the region of the limiting angle or the horizontal position and then by the effect of gravity and the inclined plane which is formed in the vent passage so that discharge is prevented until there is a further tilting of the container which results in a sucking back of the residual liquid from the vent passage back into the storage volume.

With the confirmation of the vent passage according to the invention, at no position of the container or in only a predetermined position of the container can there be an uncontrolled outflow of liquid from the inclined passage.

With the container according to the invention, it also can be ensured that a complete emptying of the last residual liquid from the container is possible. This residual emptying can be provided in combination with, but also independently from the features which have already been described so that it is thereby ensured that in a fully inverted position of the container, the housing portions bounding the supply volume from below will provide a gradient in the direction of the connecting bounding or the connecting passage between the supply or storage volume and the withdrawal or discharge volume.

In this position and with the aforementioned construction, it can be ensured that all liquid residues which may be found in the storage and supply volume will, because of the inclined planes of the wall surfaces turned toward the storage volume, be guided through the connecting opening or the connecting passage into the withdrawal volume by the effect of gravity.

The residual emptying is supported by among other features, the fact that the mentioned fully inverted position of the container also provides a gradient from the withdrawal volume in the direction of the pouring opening. Thus it can be ensured that all liquid residues which pass from the storage volume into the withdrawal volume are also guided from the latter to the pouring opening which, as has been described, is the effect of having the mouth of the pouring opening at the deepest point of the withdrawal volume in the fully inverted position of the container as has previously been described.

BRIEF DESCRIPTION OF THE DRAWING

Relevant state of the art and an example of the invention are illustrated in the following drawings and will be described in greater detail hereinafter.

The drawings show.

SPECIFIC DESCRIPTION

Figure 1:
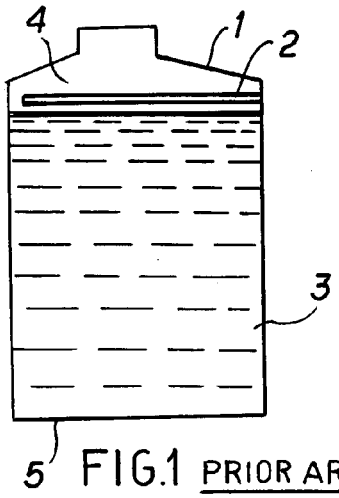
FIG.1 PRIOR ART
FIGS. 1-5: A prior-art container which is the subject matter of this description configured as a bottle in various positions.

FIG. 1 shows a container 1 of the type of which this application is concerned and known from the state of the art in the form of a bottle 1 for use, for example, for motor oil. The bottle 1 is subdivided by a partition 2 into a storage volume or supply volume 3 and a withdrawal volume or discharge volume 4. In the normal standing position shone, in which the lower housing bottom 5 is oriented horizontally, the bottle 1 is filled with a liquid, for example oil. The liquid level extends here practically up to just below the partition 2.

Figure 2:
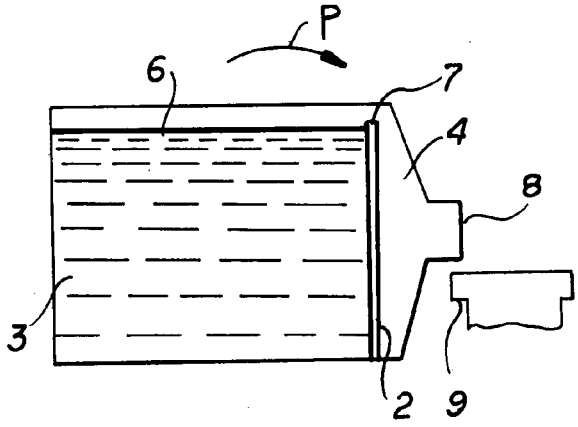
FIG.2 PRIOR ART

After tilting as shown in FIG. 2 in the direction of the arrow P through 90°, the partition 2 is substantially vertical and prevents the liquid from the storage volume 3 overflowing into the withdrawal volume 4 since the liquid level 6 of the predetermined quantity in the container is still below the upper edge or end 7 of the partition 2. Up to this limiting angle of 90°, the internal construction of the bottle 1 is such that it prevents liquid from flowing from the outlet or pouring opening 8 so that the pouring opening 8 can be first positioned with accuracy, for example above a filling fitting 9.

Figure 3:
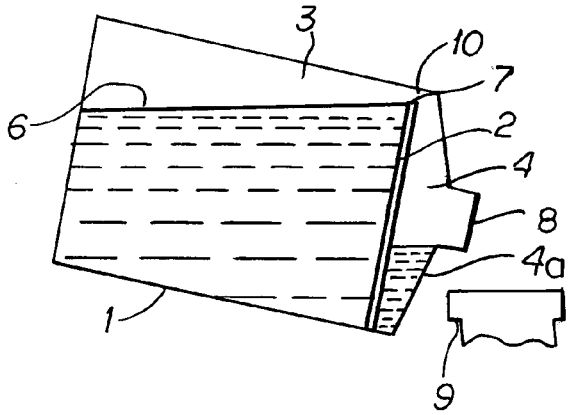
FIG.3 PRIOR ART

Only upon a further tilting beyond the limiting angle of 90° as FIG. 3 shows, will the liquid level 6 lie above the upper edge 7 of the partition 2 so that the liquid can flow into the withdrawal volume 4. In accordance with the here illustrated construction, the liquid, however, initially collects in a lower region 4*a* of the withdrawal volume 4 and only can flow from the pouring opening 8 out of the bottle when the level in the withdrawal region 4*a* reaches the height of the lower edge of the pouring opening 8.

Thus the bottle 1 illustrated here in FIGS. 1-5 has substantially two barriers which must be overcome by the liquid before it emerges from the pouring opening 8, namely a first barrier, the upper edge 7 of the partition 2, and a second barrier, the lower edge of the pouring opening 8. Because of these two barriers which must be overcome in succession, there is no possibility for a person to have highly sensitive control of the liquid quantity which is discharged and thus the possibility of a highly accurate dosing of the liquid quantity so that the bottle 2 is not appropriate for fine pouring and the supply of hazardous substances.

Figure 4:
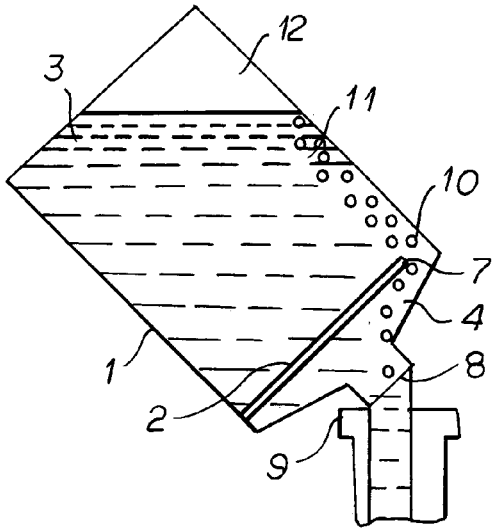
FIG.4 PRIOR ART

FIG. 4 shows a further tilting of the bottle 1 in which the withdrawal volume 4 and the throughgoing opening 10 above the edge 7 of the partition 2, which connects the withdrawal volume 4 with the supply volume 3, is completely filled with liquid. As the liquid flows from the outlet opening 8 from the bottle 1, an underpressure develops in the storage volume 3 which must be equalized to allow additional liquid to be discharged from the bottle. In the illustrated case, a pressure equalization is effected in that air is drawn into the pouring opening 8 which passes in the form of more or less large bubbles 11 through the withdrawal volume 4, the throughgoing opening 10 and the liquid in the storage volume 3 to the upper region 12 of the bottle. Since the pressure equalization as a rule is of an impulsive nature, correspondingly large pressure variations can develop within the bottle 1 which can give rise to an irregular outflow of the liquid from the pouring opening and thus also the possible spraying or scattering of the liquid. On this ground as well, the illustrated known bottle 1 is not suitable for discharge selectively in a controlled flow of hazardous liquids.

Figure 5:
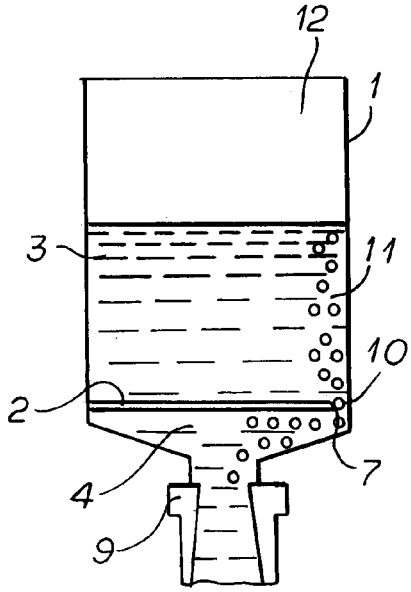
FIG.5 PRIOR ART

FIG. 5 shows a situation in which the bottle 1 is illustrated in the fully inverted position. This position which corresponds to a tilting angle of 180°, also indicates the aforementioned drawbacks of the impulsive pressure equalization and makes clear that the bottle 1 cannot be completely emptied in this position since, on the upper surface partition 2, especially in the case of high viscosity, thick liquid residues can remain which cannot find their way through the connecting opening into the withdrawal volume 4. Thus disposal of such a bottle 1 with residues is highly undesirable from the point of view of environmental protection and furthermore, the residue is lost as a valuable substance.

Figure 6:
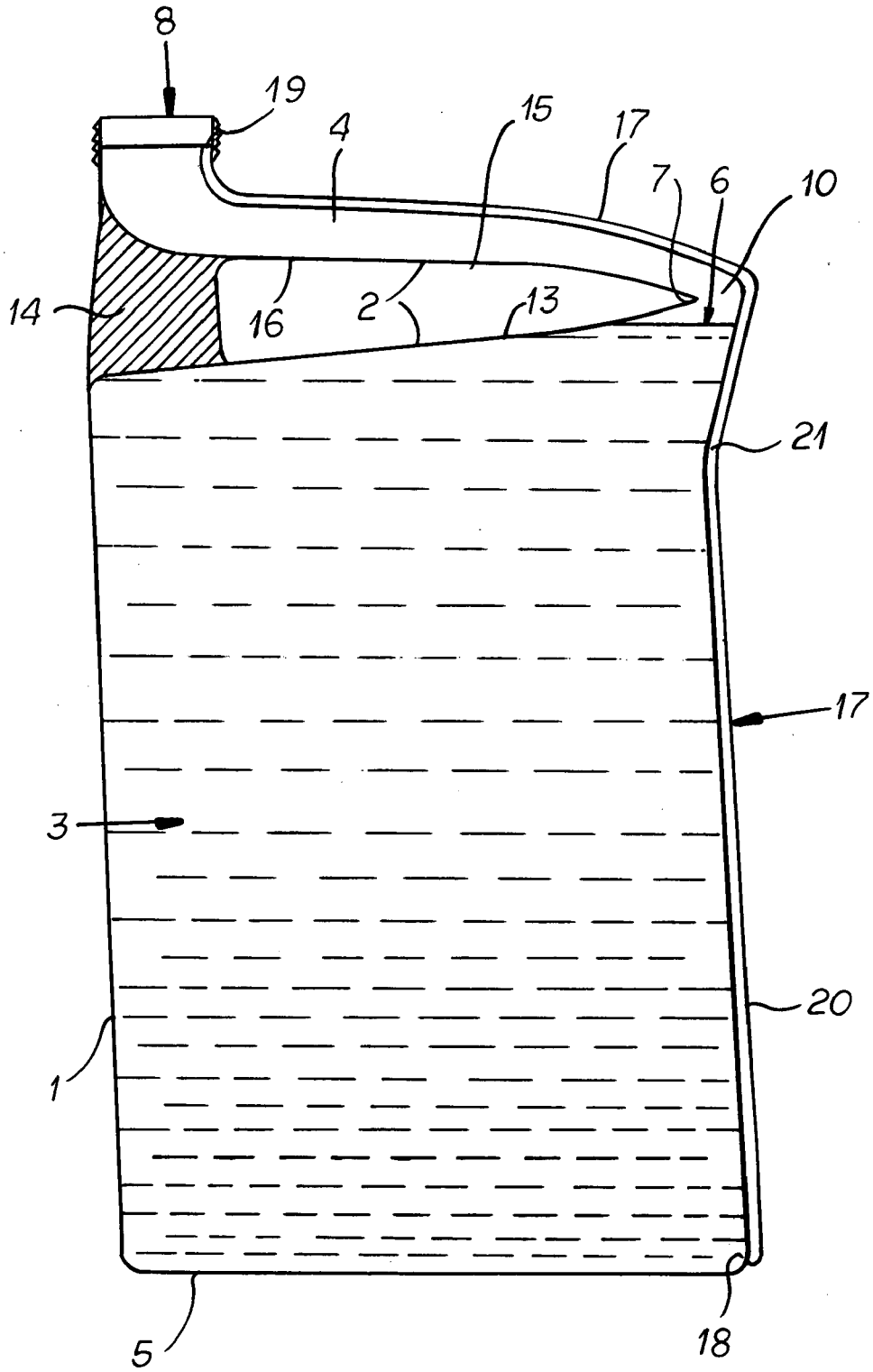
FIGS. 6-11: Respective sectional views of a liquid-filled container according to the invention in different tilting angles.
Figure 8:
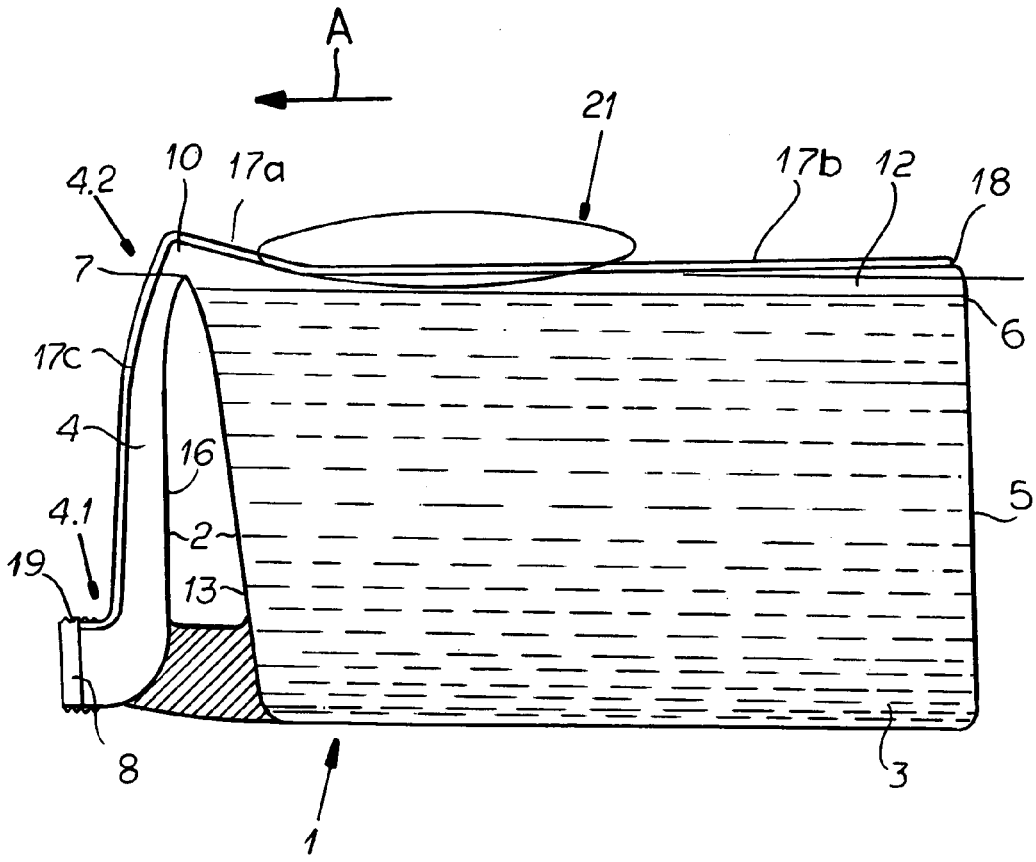

FIG. 6 shows the container according to the invention in the form of a bottle 1 for the storage and pouring of liquids with an interior and a pouring opening 8, the interior being subdivided into a storage volume 3 and a withdrawal volume 4 which are connected with one another through the connecting opening 10 so that in a normal vertical standing position of the container according to FIG. 6, the withdrawal volume 4 is located above the storage volume 3 and an overflow of liquid from the storage volume 3 into the withdrawal volume 4 is prevented until the bottle 1 is tilted beyond the predetermined limiting angle according to FIG. 8 from the vertical position.

In FIG. 6 and following illustrations, it is clear that the withdrawal volume 4 so opens at the pouring opening 8 that the pouring opening upon a tilting of the container, as has been shown in FIGS. 8-11, between the limiting angle (FIG. 8) and the fully inverted position (FIG. 11) of the bottle 1, always forms the lowest point of the withdrawal volume 4.

This is especially clear in FIG. 8, where the bottle 1 is shown in the limiting angle position, that is having rotated through 90° in the counterclockwise sense. According to the present configuration of the withdrawal volume 4 the bottle 1 has a vent passage 17, one portion 4.1 of which opens into the pouring opening 8 and another portion 4.2 portion of which extends through the connecting opening 10 into the storage volume 3. In this position, as illustrated in FIG. 8, the pouring opening 8 assumes the lowest point of the withdrawal volume 4 which is always the case for the further rotated or tilted positions of FIGS. 9, 10 and 11 until the fully inverted position is reached.

At all angles beyond the limiting angle up to the attainment of the fully inverted position, the pouring opening 8 is always at the lowest position of the withdrawal volume 4 which prevents the formation in the withdrawal volume 4 of regions in which the liquid must initially collect before it is discharged from the pouring opening 8 and which has been found to be a drawback in the state of the art. Such a bottle construction enables a fine feel for the metering of the discharge of the liquid.

Figure 7:
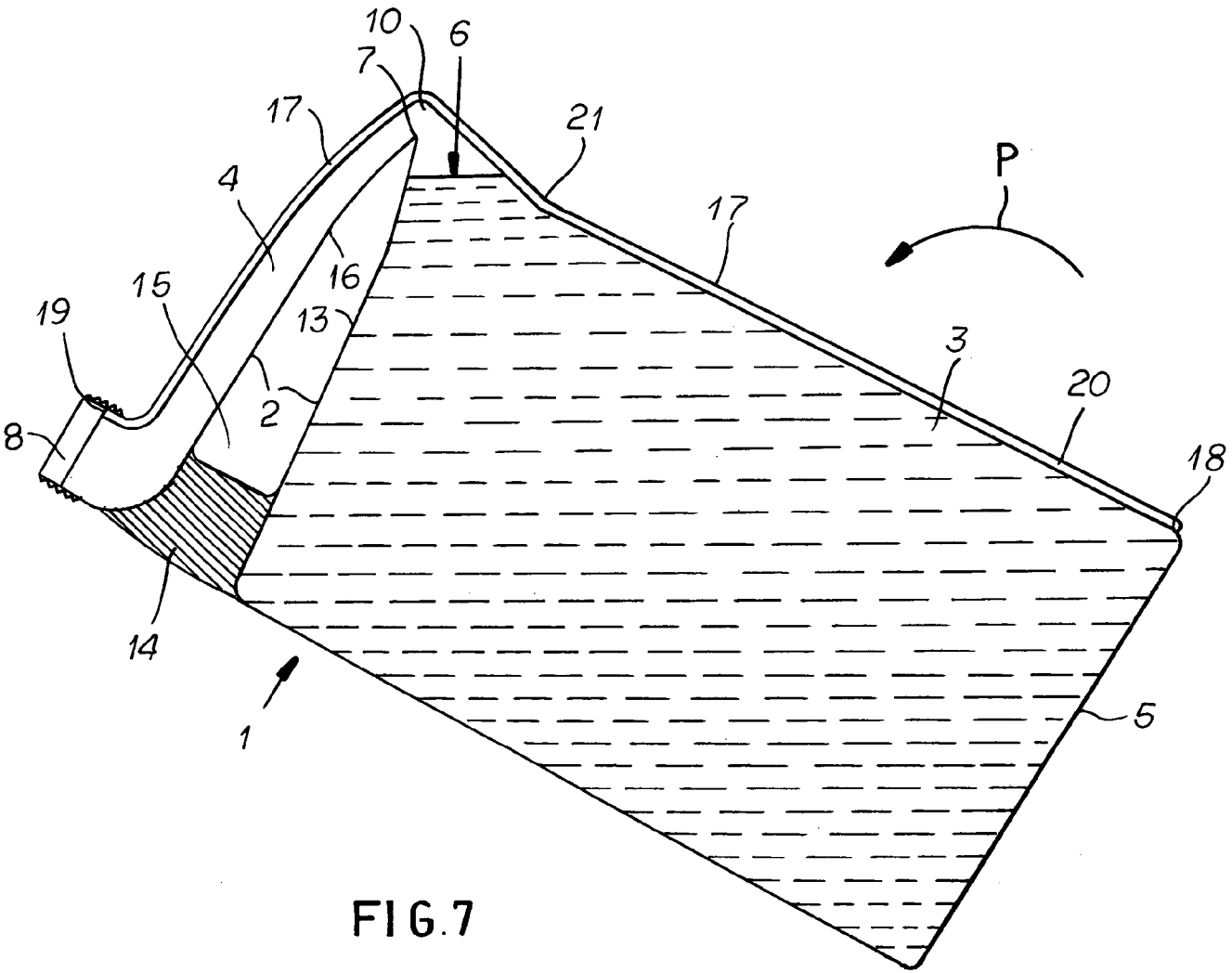

From FIG. 7 it will be apparent that the pouring opening forms the lowest point of the withdrawal volume 4 upon tilting even at angles less than the limiting angle and as seen since the pouring opening 8 upon rotation is located below the transfer opening 10 between the two volumes 3 and 4. This is a consequence of how the passage forming the withdrawal volume 4 runs from its beginning in the transfer region 10 to its end in the pouring opening 8.

The bottle 1 according to the invention utilizes the important features of the invention when it is filled with a quantity of liquid so that the liquid level 6 in the upright vertical position of the bottle according to FIG. 6 lies below the transfer opening 10 or the edge 7 of the partition. This maximum quantity to which the bottle can be filled is the prerequisite for an unobjectionable utilization of the features of the invention.

If then the bottle 1 is tilted to the limiting angle according to FIG. 7 in the counterclockwise sense represented by the direction of the arrow P, the liquid level 6 will remain below the transfer opening 10 or the edge 7 between the two volumes 3 and 4 until the limiting angle, in this case 90°, is reached according to FIG. 8. Upon a further rotation beyond the limiting angle so that the bottle 1 assumes the position shown in FIG. 9, the liquid passes above the opening 10 or over the edge 7 into the withdrawal volume 4 which is configured as a passage and from there by gravity flows to the outlet or pouring opening 8 located at the deepest point so that it can emerge from the bottle.

The bottle according to the invention has the advantage that upon tilting up to the limiting angle, in the present case 90°, no liquid will flow out of the pouring opening so that the pouring opening 8 can, for example, be accurately positioned above a filling fitting (not shown).

In the present case of the illustrated bottle 1, the withdrawal passage 4 is formed as a tubular segment on the uppermost housing portion of the bottle 1 in one piece and in the region of the transfer opening 10 is so configured that this passage-shaped tubular segment extends above the housing region which borders the storage volume 3 from above. Corresponding to the illustration, the passage-shaped withdrawal volume 4 can be configured as a grip enabling the bottle according to the invention to be safely carried. For stabilizing the grip element which is formed by the withdrawal passage 4, a rib 14 is provided which connects a region below the pouring opening 8 with the region lying therebeneath of the upper housing region 13 of the storage volume 3 so that between this rib 14 and the one-piece transition, the opening 10 is formed between the volumes 3 and 4 and defines a grip 15 for receiving fingers of a hand.

The here illustrated construction can also be such that an upper housing wall 13 of the storage volume 3 and the lower limiting housing wall of the withdrawal passage 4 form the two side surfaces of a partition 2 by means of which the interior volume of the bottle 1 according to the invention is subdivided into the storage volume 3 and the withdrawal volume 4 connecting the regions formed by these housing regions 13 and 16 corresponding to the edge 7 of this partition between opposite sides of which the liquid passes between the volumes 3 and 4 in the transfer region 10.

By contrast with the state of the art, the bottle 1 according to the invention has the advantage that, upon the discharge of liquid there is a sufficient ventilation of the storage volume 3. This is achieved by the vent passage 17 which extends from the pouring opening 8 and opens into the storage volume 3. As a consequence with the present embodiment, an inner opening or end 18 of the ventilation passage 17 in the storage volume 3 lies diametrically opposite the pouring opening 8 so that upon a tilting of the bottle 1 according to FIGS. 9, 10 and 11, the mouth opening 18 of the vent passage 17 is so arranged in the storage volume 3 that it always lies at the highest point. As a result the system according to the invention ensures that the air which is drawn in at the pouring opening 8 without coming into contact with the liquid can enter an upper ventilated region 12 of the storage volume 3 without agitating the liquid or creating turbulence therein. Through this construction, the vent passage 17 ensures a uniform and passive liquid discharge.

Figure 12:
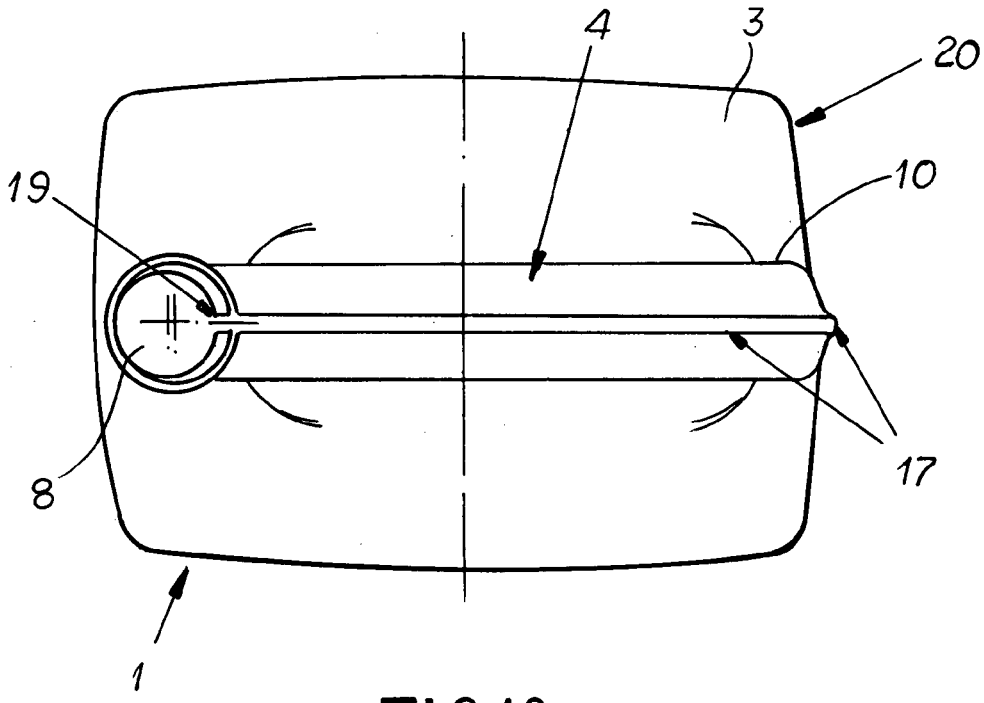
FIG. 12: A plan view of a container according to the invention.
Figure 13:
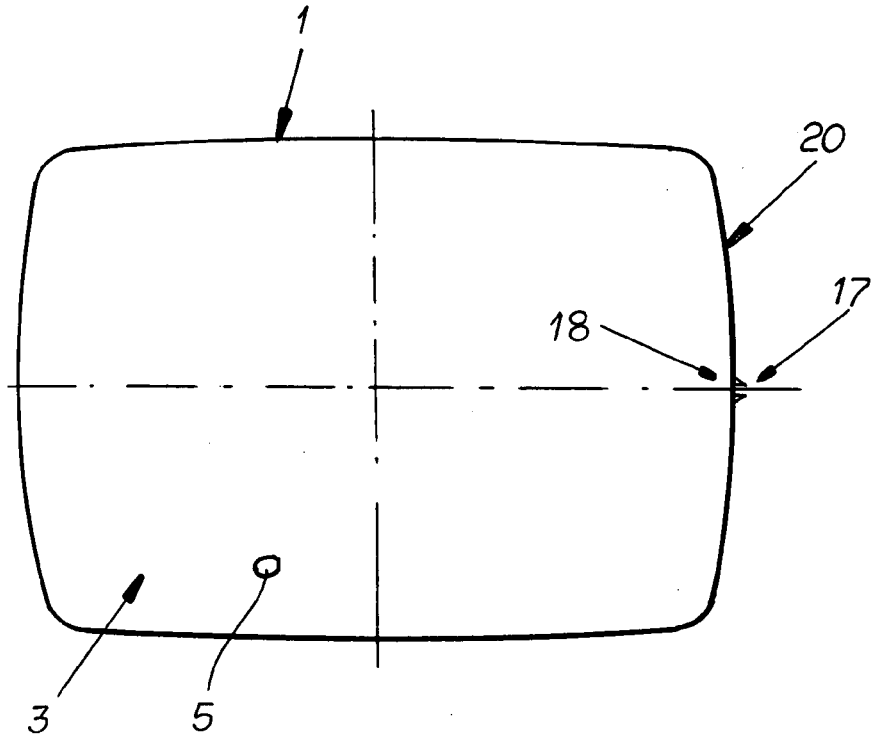
FIG. 13 A plan view from below of the base surface of a container according to the invention.
Figure 14:
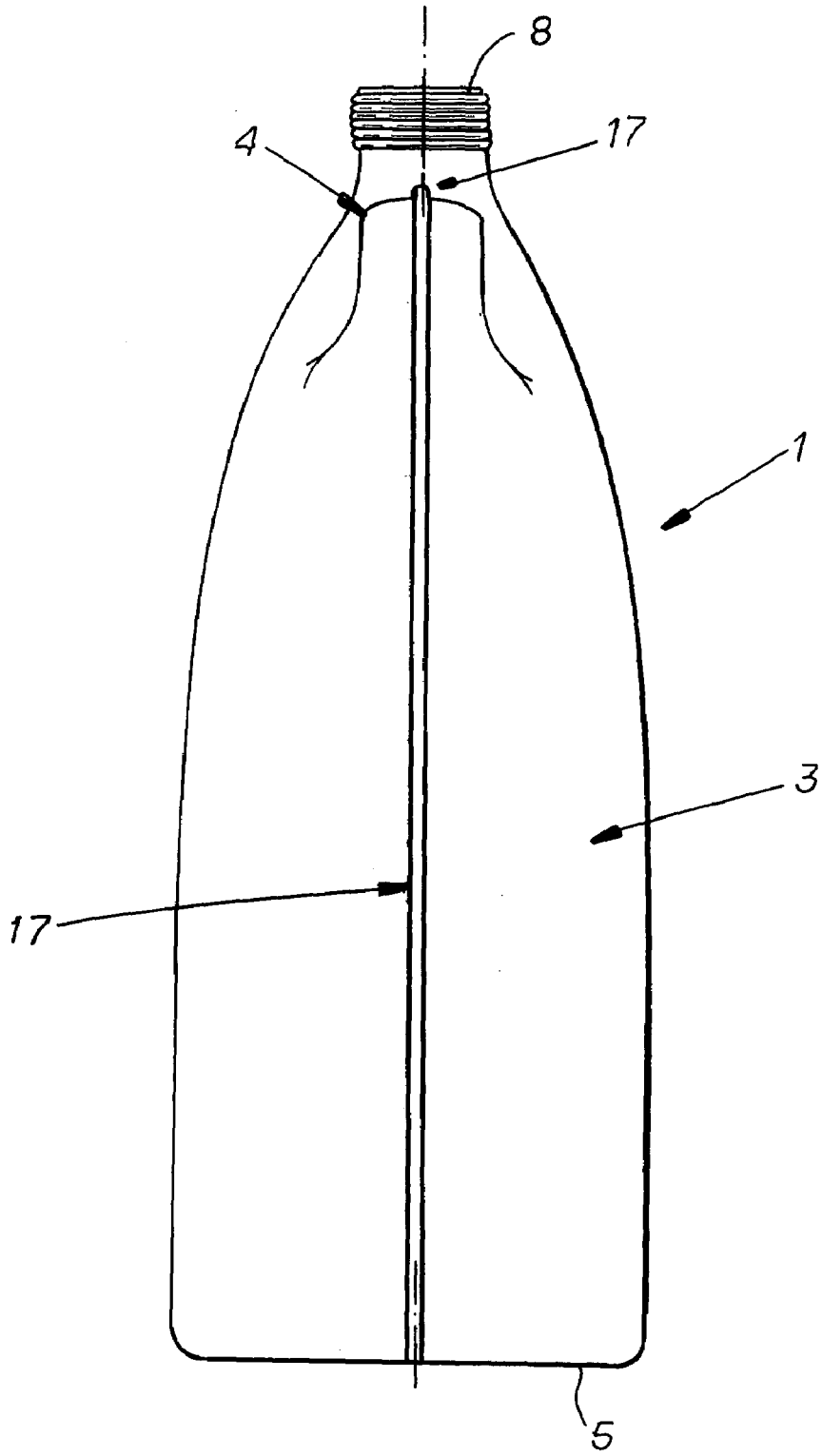
FIG. 14 A rear view of the container according to the invention.

Especially FIGS. 12 and 13 show that an opposite outer opening or end 19 of the vent passage 17 is located in the pouring opening 8 at an upper region thereof in the tilted position so that this mouth opening 19, through which air is sucked into the bottle, is not wetted by the outflowing liquid. This can prevent the underpressure in the storage volume 3 from sucking liquid back into the vent passage and stopping it up. Furthermore, it can be deduced from FIGS. 12 and 13 that the vent passage 17 is arranged on the upper surface of the bottle 1 and above the withdrawal passage 4 configured as a grip and with reference to FIGS. 12 and 13, above a right side surface 20 of the bottle 1 to extend to a point where the vent passage 17, as FIGS. 6 and 14 show, opens at the lowest point at the end 18 in the storage volume 3 in an upright position of the bottle 1. Alternatively there is a possibility in another construction of the vent passage to be arranged directly within the housing wall of the container 1.

To prevent the liquid from flowing in an uncontrolled manner to the pouring opening 8 from the vent passage 17 where the liquid is at the level 6 shown in FIG. 6, the bottle 1 according to the invention has a special construction which can be seen in its important aspect from FIG. 8. FIG. 8 shows the limiting angular position of the container 1, that is a tilting through 90° from the vertical position and from which it can be seen that the vent passage 17 has at least in a partial segment 17*a* an upward incline in the pouring direction A and thus to the left, which is of increasing height. FIG. 8 also shows the advantageous configuration of the vent passage 17 between its inner end 18 and the aforementioned partial segment 17*a* which has a further passage segment 17*b* which lies below the above-described mouth opening 18. As a result, there is a sharp bend between the initial descending portion 17*b* from the end 18 and then into segment 17*a* a sharp rise in the path of the vent passage 17 which ensures that in the illustrated limiting angular position, residual liquid in the vent passage 17 will collect at the bend 21, especially ahead of the sharply rising segment 17*a* of the vent passage 17 and because of the effect of gravity, will be prevented from the passing to the descending region 17*c* of the vent passage 17 on the left side of the segment 17*a*.

Figure 9:
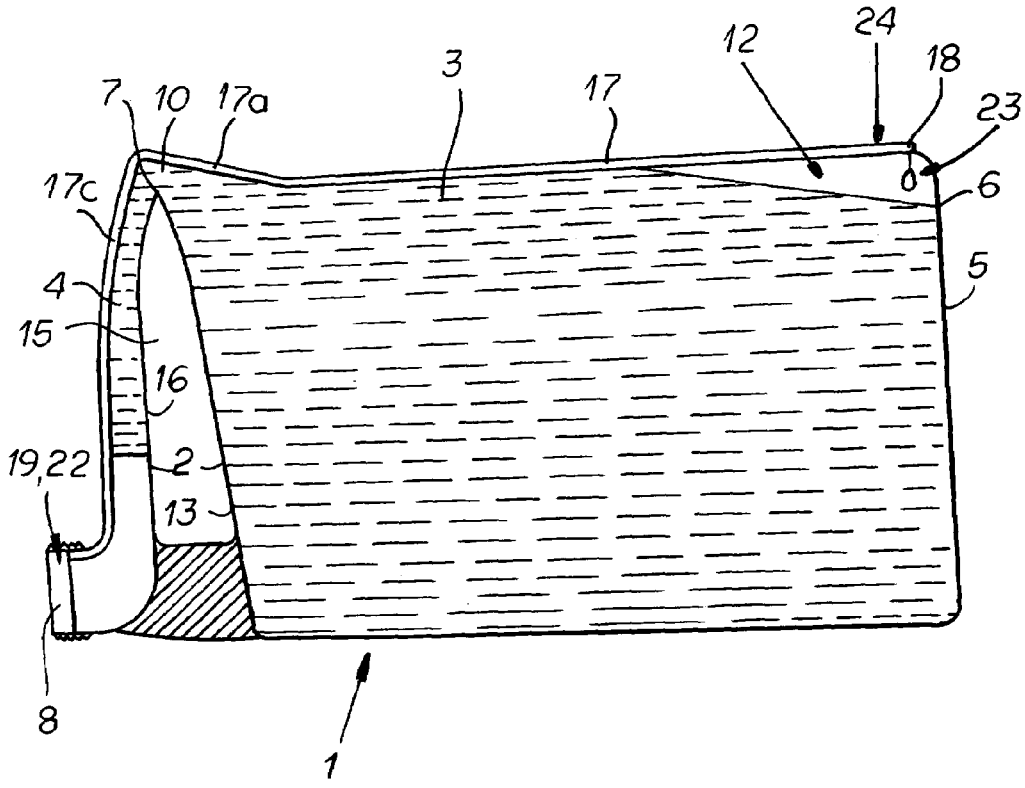
Figure 10:
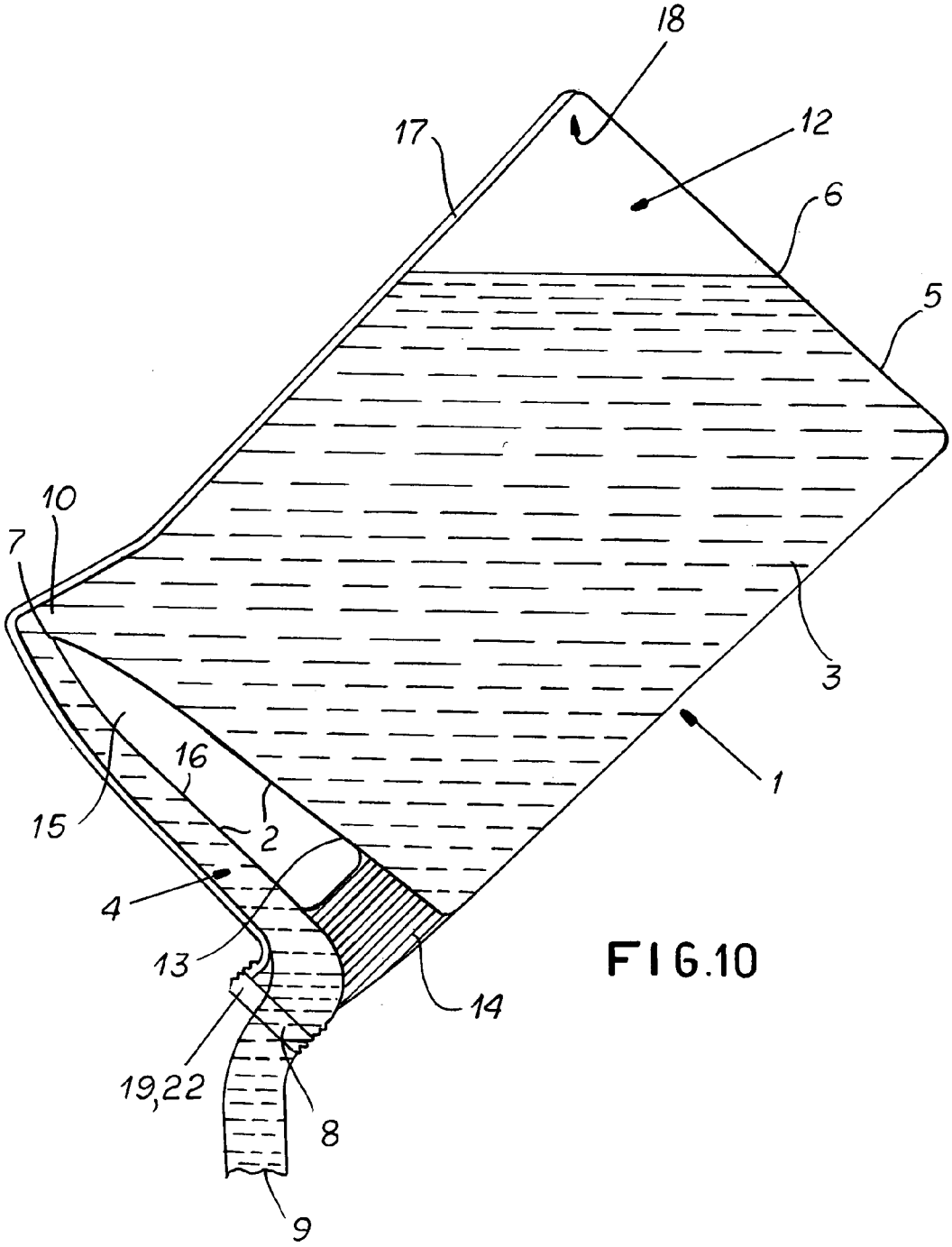

If the bottle 1 of the invention is tilted further beyond the limiting angle as is seen in FIG. 9, the liquid passes over the connecting opening 10 into the withdrawal volume 4 and thus both the withdrawal volume 4 and the throughgoing opening 10 will completely close so that through the underpressure produced by the liquid discharge in the storage volume 3, a pressure equalization can only occur through the vent passage 17.

Correspondingly air 22 is sucked in through the vent passage 17 and drives back the residual liquid quantity 2 collected in the bend 22 in the direction of the mouth opening 18 so that this residual liquid 24 as shown in FIG. 9 will pass back as droplets 23 into the storage volume 3 even before the segment 17*a* which rises in the limiting angular position reaches a horizontal orientation on further tilting according to FIG. 9 which enables a passage of the liquid into the descending vent passage region 17*c*.

Through the described construction it can be effectively ensured that an uncontrolled liquid discharge from the vent passage 17 is also prevented upon a tilting of the bottle 1 according to the invention.

To configure a vent passage 17 for the effect required by the invention, it is not necessary to subdivide the vent passage into the rising and falling passage segments 17*a* and 17*b*. It is basically sufficient that in the limiting angular position of the container, the vent passage 17 starting from the mouth opening 18 in the storage volume have a rising inclination especially with respect to the liquid level 6 in the storage volume 3. A sufficiently precise and satisfactory positioning of the rising segment 17*a* of the vent passage 17 is then achieved when the segment 17*a* of the vent passage lying above the mouth opening 18 in the limiting angular position (FIG. 8), in the vertical normal orientation (FIG. 6) of the bottle 1 and all the positions intervening therebetween at least segmentally is arranged above the connecting opening 10 between the volume 3 and 4. In this case in the mentioned positions the residual liquid quantity 24 in the vent passage 17 always flows out of the rising vent passage segment 17*a* which presents a further flow toward the pouring opening 8.

Figure 11:
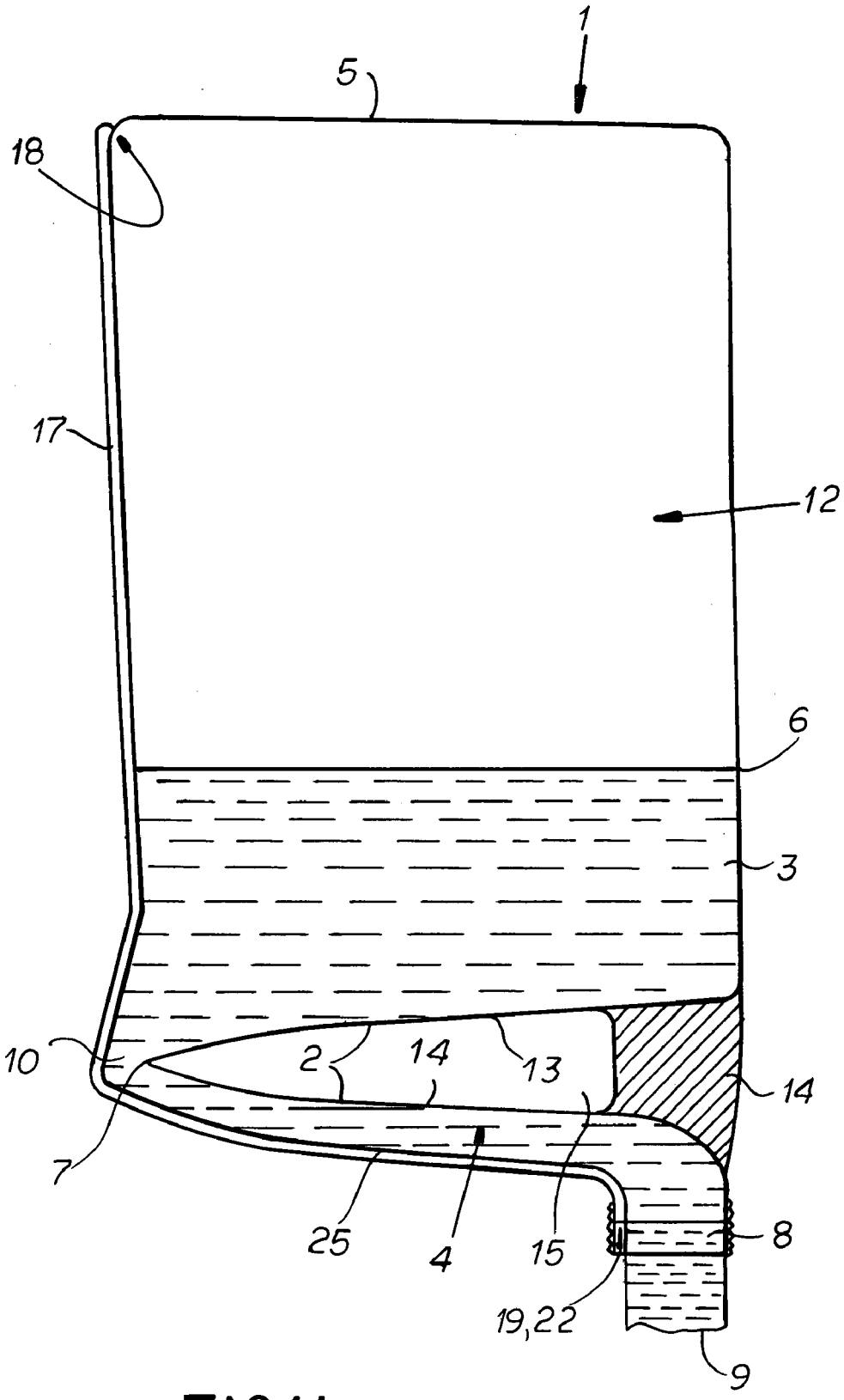

FIG. 11 makes clear that in the fully inverted position of the bottle according to the invention, complete emptying of residue is also possible without the need for the person who desires to empty the bottle to think about the exact positioning. FIG. 11 here shows that in the fully inverted position, the housing region 13 bounding the storage volume 3 of the bottle 1 from below has a gradient in the direction of the connecting opening 10 between the storage volume and the withdrawal volume 4. If then the bottle according to the invention is only approximately vertical in its fully inverted orientation, this gradient will ensure that all liquid of the storage volume 3 will be reliably guided to the connecting opening 10 by gravity and from there will flow into the withdrawal volume 4 or the discharge passage 4.

Since the withdrawal volume 4 or the discharge passage 4 is also the housing region 25 which forms the lower boundary of the housing, a gradient in the direction of the pouring opening 8 is provided and ensures that the liquid quantities which have found their way to the withdrawal volume 4 will also reliably pass to the pouring opening 8 which forms the lowest point of the withdrawal volume 4. Thus a reliable emptying of residues is ensured. Alternatively to the illustrated configuration in the embodiment shown, a construction is possible in which a partition within the container volume ensures a complete emptying of residues to the extent that the partition 2 has a edge 7 which at the opening and the partition has a tapering path to the opening which is so formed that the wall side 13 of the partition which is turned toward the storage volume provides in the fully inverted position a gradient in the direction of the opening 10.

The previously described bottle based upon its structural features is especially suitable for the uniform metered discharge of liquid from the bottle as well as a complete arranging of all residues even with liquid hazardous material.

The invention claimed is:

1. A container for the storage and pouring of liquid, with an interior and a pouring opening, the interior being subdivided into a storage volume and a withdrawal volume which are connected with one another by a overflow opening, so that in a normal vertical standing position of the container the withdrawal volume is above the supply volume and an overflow of liquid from the supply volume into the withdrawal volume is prevented until the container is tilted from the vertical position beyond a predetermined limiting angle, characterized in that the container has a vent passage which extends from an outer end at the pouring opening and opens at an inner end into the storage volume and in the limiting angular position of the container a segment of the vent passage lies above the overflow opening, and in the limiting angular position of the container the vent passage segment is disposed above the passage inner end.

2. The container according to claim 1 characterized in that the passage outer end lies diametrically opposite the pouring opening.

3. The container according to claim 1 characterized in that the passage inner end is so located in the storage volume that upon tilting of the container over an angle greater than the limiting angle, the passage inner end lies in an upper region of the storage volume.

4. The container according to claim 1, characterized in that the vent passage is formed within the wall of the container housing or on the wall thereof, in the limiting angle position of the container within or on a region of the wall which lies upwardly of the container housing.

5. The container according to claim 1, characterized in that in the limiting angular position of the container the vent passage at least in a partial segment has a portion running upwardly in height in the pouring direction.

6. The container according to claim 1, characterized in that upon a tilting of the container in the limiting angle, the withdrawal volume opens into an upper region of the storage volume.

7. The container according to claim 1, characterized in that the withdrawal volume and the storage volume are formed by a partition which subdivides the interior of the container.

8. A container for the storage and pouring of liquid, with an interior and a pouring opening, the interior being subdivided into a storage volume and a withdrawal volume which are connected with one another by a overflow opening, so that in a normal vertical standing position of the container the withdrawal volume is above the supply volume and an overflow of liquid from the supply volume into the withdrawal volume is prevented until the container is tilted from the vertical position beyond a predetermined limiting angle, characterized in that the container has a vent passage which extends from an outer end at the pouring opening and opens at an inner end into the storage volume and in the limiting angular position of the container a segment of the vent passage lies above the overflow opening, and the withdrawal volume so opens into the pouring opening that the pouring opening upon a tilting of the container between the limiting angle and a fully inverted position of the container always forms the deepest location of the withdrawal volume.

9. The container according to claim 8 characterized in that the withdrawal volume is formed as a passage whose one end opens in the pouring opening and whose other end opens in the storage volume.

10. The container according to claim 9, characterized in that the container housing region of the passage forming the withdrawal volume forms a grip.

11. The container according to claim 9, characterized in that a housing region of the withdrawal volume is connected with a housing region of the storage volume through at least one rib with a spacing corresponding to the transition region between both volumes.

12. A container for the storage and pouring of liquid, with an interior and a pouring opening, the interior being subdivided into a storage volume and a withdrawal volume which are connected with one another by a overflow opening, so that in a normal vertical standing position of the container the withdrawal volume is above the supply volume and an overflow of liquid from the supply volume into the withdrawal volume is prevented until the container is tilted from the vertical position beyond a predetermined limiting angle, characterized in that the container has a vent passage which extends from an outer end at the pouring opening and opens at an inner end into the storage volume and in the limiting angular position of the container a segment of the vent passage lies above the overflow opening, and in a fully inverted position of the container, the storage volume has a housing region bounding the lower portion of the container with a gradient in the direction of the connecting opening or the overflow opening between the storage volume and the withdrawal volume and the withdrawal volume has a housing region of the container bounding it with a gradient in the direction of the pouring opening.

13. The container according to claim 12, characterized in that in the limiting angular position of the container the vent passage segment is disposed above the passage inner end.

14. The container according to claim 13, characterized in that the vent passage between the passage segment lying above the passage inner end and the passage inner end has at least a further passage segment which is located below the passage inner end.

* * * * *